US011310590B2

(12) United States Patent
Bork

(10) Patent No.: US 11,310,590 B2
(45) Date of Patent: Apr. 19, 2022

(54) EMERGENCY REPORTING DEVICE IN A MOTOR VEHICLE

(71) Applicant: Volkswagen Aktiengesellschaft, Wolfsburg (DE)

(72) Inventor: Simon Bork, Calberlah (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 17/052,253

(22) PCT Filed: Apr. 8, 2019

(86) PCT No.: PCT/EP2019/058812
§ 371 (c)(1),
(2) Date: Nov. 2, 2020

(87) PCT Pub. No.: WO2019/211065
PCT Pub. Date: Nov. 7, 2019

(65) Prior Publication Data

US 2021/0258683 A1 Aug. 19, 2021

(30) Foreign Application Priority Data

May 2, 2018 (DE) ..... 10 2018 206 779.1

(51) Int. Cl.
*H04R 1/32* (2006.01)
*G08B 25/01* (2006.01)
(Continued)

(52) U.S. Cl.
CPC ..... *H04R 1/323* (2013.01); *G08B 25/016* (2013.01); *G08G 1/205* (2013.01); *H04R 1/40* (2013.01); *H04R 2499/13* (2013.01)

(58) Field of Classification Search
CPC . H04R 1/32; H04R 1/323; H04R 1/34; H04R 1/345; H04R 1/38; H04R 2499/13;
(Continued)

(56) References Cited

U.S. PATENT DOCUMENTS 5,096,252 A * 3/1992 Brown ..... B60R 11/0217 181/141
6,273,499 B1 * 8/2001 Guyon ..... B60R 13/0212 174/72 A
(Continued)

FOREIGN PATENT DOCUMENTS

CN 1910823 A 2/2007 ..... B60R 1/12
DE 10003687 A1 8/2000 ..... B60Q 1/52
(Continued)

OTHER PUBLICATIONS

German Office Action, Application No. 102018206779.1, 7 pages, dated Nov. 13, 2018.
(Continued)

*Primary Examiner* — Kile O Blair
(74) *Attorney, Agent, or Firm* — Slayden Grubert Beard PLLC

(57) ABSTRACT

An emergency reporting device in a motor vehicle for manually and/or automatically reporting an emergency to a report center is provided. A hands-free communication apparatus, consisting of at least one microphone and at least one loudspeaker, can be used to communicate with the report center. The microphone is arranged in a first vertical plane extending perpendicularly to a longitudinal direction of the motor vehicle, and the loudspeaker is arranged separate from the microphone in a second vertical plane extending perpendicularly to the longitudinal direction of the motor vehicle. Furthermore, the microphone and the loudspeaker
(Continued)

are additionally arranged in a central region of the motor vehicle containing a vertical longitudinal center plane.

20 Claims, 5 Drawing Sheets

(51) Int. Cl.
*G08G 1/00* (2006.01)
*H04R 1/40* (2006.01)

(58) Field of Classification Search
CPC .. G08B 25/016; G08B 25/001; G08B 25/006; H04W 4/90; B60R 11/0217; B60R 11/0241; B60R 11/0247; B60R 2001/1284; B60R 2021/0027
See application file for complete search history.

(56) References Cited

U.S. PATENT DOCUMENTS

| | | | | |
|---|---|---|---|---|
| 6,278,377 | B1 | 8/2001 | Deline et al. | 340/815.4 |
| 6,337,641 | B1 | 1/2002 | Yoshioka et al. | 340/989 |
| 7,266,204 | B2 | 9/2007 | Watson et al. | 381/86 |
| 9,998,892 | B2 | 6/2018 | Tzirkel-Hancock et al. | |
| 2002/0032048 | A1 | 3/2002 | Kitao et al. | 455/569.2 |
| 2002/0037707 | A1 | 3/2002 | Yoshioka et al. | 455/404.2 |
| 2003/0219137 | A1 | 11/2003 | Fincham et al. | 381/302 |
| 2004/0185800 | A1 | 9/2004 | Van Bosch et al. | 455/99 |
| 2005/0153680 | A1 | 7/2005 | Yoshioka et al. | 455/404.1 |
| 2009/0110185 | A1 | 4/2009 | Yamamoto | 379/406.01 |

FOREIGN PATENT DOCUMENTS

| | | | | |
|---|---|---|---|---|
| DE | 10137689 | A1 | 4/2002 | B60R 21/00 |
| DE | 102005058826 | A1 | 6/2007 | B60R 11/02 |
| DE | 102009039889 | A1 | 3/2011 | B60R 11/02 |
| DE | 102011008555 | A1 | 7/2012 | B60R 11/02 |
| DE | 102013006068 | A1 | 10/2014 | H04R 5/02 |
| DE | 102015205686 | A1 | 10/2016 | B60R 11/02 |
| DE | 202016105209 | U1 | 10/2016 | B08B 25/10 |
| DE | 102016123616 | A1 | 6/2017 | B60R 11/02 |
| DE | 102018206779 | A1 | 11/2019 | B60R 11/02 |
| EP | 1188617 | A2 | 3/2002 | H04B 1/38 |
| EP | 1634479 | B1 | 10/2011 | H04B 1/00 |
| FR | 2998085 | A | 5/2014 | B60R 11/02 |
| WO | 2016/155895 | A1 | 10/2016 | H04R 1/00 |
| WO | 2019/211065 | A1 | 11/2019 | H04R 1/32 |

OTHER PUBLICATIONS

International Search Report and Written Opinion, Application No. PCT/EP2019/058812, 22 pages, dated Jun. 27, 2019.
Chinese Office Action, Application No. 201980027560.7, 14 pages, dated Dec. 3, 2021.

* cited by examiner

EMERGENCY REPORTING DEVICE IN A MOTOR VEHICLE

CROSS-REFERENCE TO RELATED APPLICATIONS

This application claims priority to German Patent Application No. DE 10 2018 206 779.1, filed on May 2, 2018 with the German Patent and Trademark Office. The contents of the aforesaid patent application are incorporated herein for all purposes.

TECHNICAL FIELD

The invention relates to an emergency reporting device in a motor vehicle.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

Starting on Mar. 31, 2018, in some jurisdictions, an emergency reporting device is required to be installed in all new vehicles. It should be able to place an emergency call to a rescue or report center automatically or also by means of a simple actuation apparatus in the interior of the vehicle when an emergency situation arises.

Such an emergency situation can be, for example, a traffic accident or a critical health state of a vehicle occupant.

In addition to necessary electrical storage and computing units for carrying out an "emergency strategy" as well as GPS apparatuses for locating the motor vehicle, at least one microphone as well as at least one loudspeaker allowing the vehicle occupant(s) to freely speak and hear in an emergency are central components of such an emergency reporting device.

SUMMARY

An object exists to provide an emergency reporting device in a motor vehicle with which good acoustic properties can be achieved and applicable regulations can be met in a simple manner.

The present object is achieved by an emergency reporting device with the features of claim 1. Embodiments of the invention are discussed in the dependent claims and the following description.

The details of one or more embodiments are set forth in the accompanying drawings and the description below. Other features will be apparent from the description, drawings, and from the claims.

DETAILED DESCRIPTION

Figure 1:
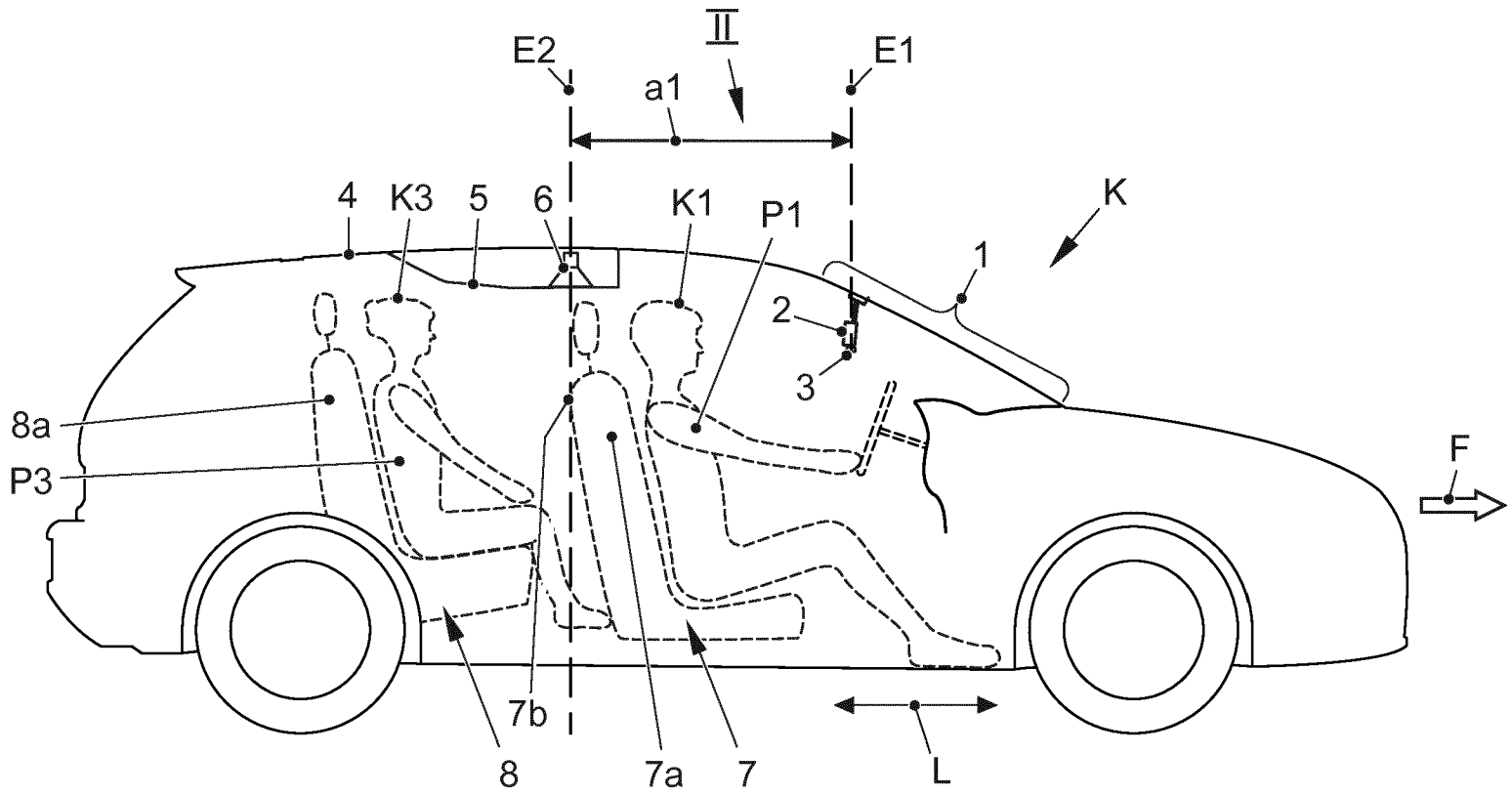
FIG. 1 shows a lateral representation of a motor vehicle in one embodiment.

In the following description of embodiments of the invention, specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

According to a first exemplary aspect, an emergency reporting device in a motor vehicle for manually and/or automatically reporting an emergency to a report center is provided. A hands-free communication apparatus consisting of at least one microphone and at least one loudspeaker can be used to communicate with the report center. The microphone is arranged in a first vertical plane extending perpendicularly to a longitudinal direction of the motor vehicle, and the loudspeaker is arranged separate from the microphone in a second vertical plane extending perpendicularly to the longitudinal direction of the motor vehicle. Furthermore, the microphone and the loudspeaker are additionally arranged in a central region of the motor vehicle containing a vertical longitudinal center plane.

According to the first exemplary aspect, it is proposed that the first plane, viewed in a usual direction of travel of the motor vehicle, is located behind the second plane, and the second plane, viewed counter to the direction of travel, is arranged in the region of the head of a vehicle driver.

As a result, an emergency reporting device which has good acoustic properties and meets current regulations can be provided simply and cost-effectively. In particular, in addition to the vehicle driver and the front-seat passenger, an occupant sitting behind a vehicle driver (back-seat passenger) can also receive sufficient sound exposure through this solution without the sound pressure level of the loudspeaker having to be selected to be so loud that it has negative effects on the acoustic properties of the emergency reporting device.

In some embodiments, it is proposed that the second plane, viewed in the longitudinal direction of the motor vehicle, is arranged in the region of an A-pillar (if present). In this case, the region of an A-pillar also comprises a certain distance from both sides of the A-pillar which, according to the experience of the applicant, can be multiple centimeters in each case.

This positioning can ensure a sufficiently close distance both from the vehicle driver and from the back-seat passenger.

In other words, in the case of an average sized person and a usual seat position selected by this person, said second plane will lie approximately within such a region which, viewed counter to the direction of travel, begins approximately at the forehead of the vehicle driver and extends behind the vehicle driver, between this driver and the back-seat passenger.

Said second plane, viewed counter to the direction of travel, is in some embodiments arranged in the rear region of the A-pillar. This leads to a sufficient sound exposure both of the vehicle driver and front-seat passenger as well as the back-seat passenger even with low acoustic pressure.

In order to achieve a cost-effective implementation of the positioning with low cabling complexity and in some embodiments, it is proposed to integrate the loudspeaker into an illumination module which is arranged on a roof liner of the motor vehicle. In principle, the roof liner can also be assessed for the loudspeaker as a crash-safe region in vehicles with low deformation potential.

In vehicles that have a separating wall behind the front seats, which can be the case, for example, in commercial vehicles or sports cars, it is expedient in some embodiments to arrange the loudspeaker on such a separating wall. Thus, the effort for a suitable positioning of the loudspeaker can also be kept low.

In some embodiments, the microphone has a directivity oriented towards the vehicle driver and a front-seat passenger. In addition, the microphone and the loudspeaker may, e.g., be arranged within the central region on the vertical longitudinal center plane of the motor vehicle.

This way, the danger of an undesirably strong sound exposure of the microphone by the loudspeaker in what is known as doubletalk operation can be even more effectively avoided. Doubletalk operation is understood to mean such operation in which the speech of a conversational partner from the report center is audible through the loudspeaker, and the microphone is exposed to the sound of both the speech of the conversational partner and the speech of the occupant(s). But the computing effort for the echo cancelation filter downstream in the signal processing can also be designed more simply in singletalk operation since less feedback from the loudspeaker into the microphone can be assumed.

In some embodiments, it is conceivable if the microphone has a cardioid characteristic, wherein two loudspeakers are present which are connected as a dipole. This occurs such that a sound pressure level of the loudspeakers in the direction of the microphone is very low or minimal. As a result, an undesirably strong sound exposure of the microphone by the loudspeaker in what is known as doubletalking operation can be even more effectively avoided.

Further embodiments are shown in the FIGS. and are described in more detail in the following description with reference to the FIGS. Additional benefits will become clear in the process. Identical reference numerals, even in different FIGS., refer to identical, comparable, or functionally identical components. Corresponding or comparable properties and benefits are achieved in this case, even if a repeated description or reference thereto does not occur. The FIGS. are not or at least not always true to scale. In some FIGS., proportions or distances may be shown exaggerated in order to be able to more clearly emphasize features of an exemplary embodiment.

Figure 2:
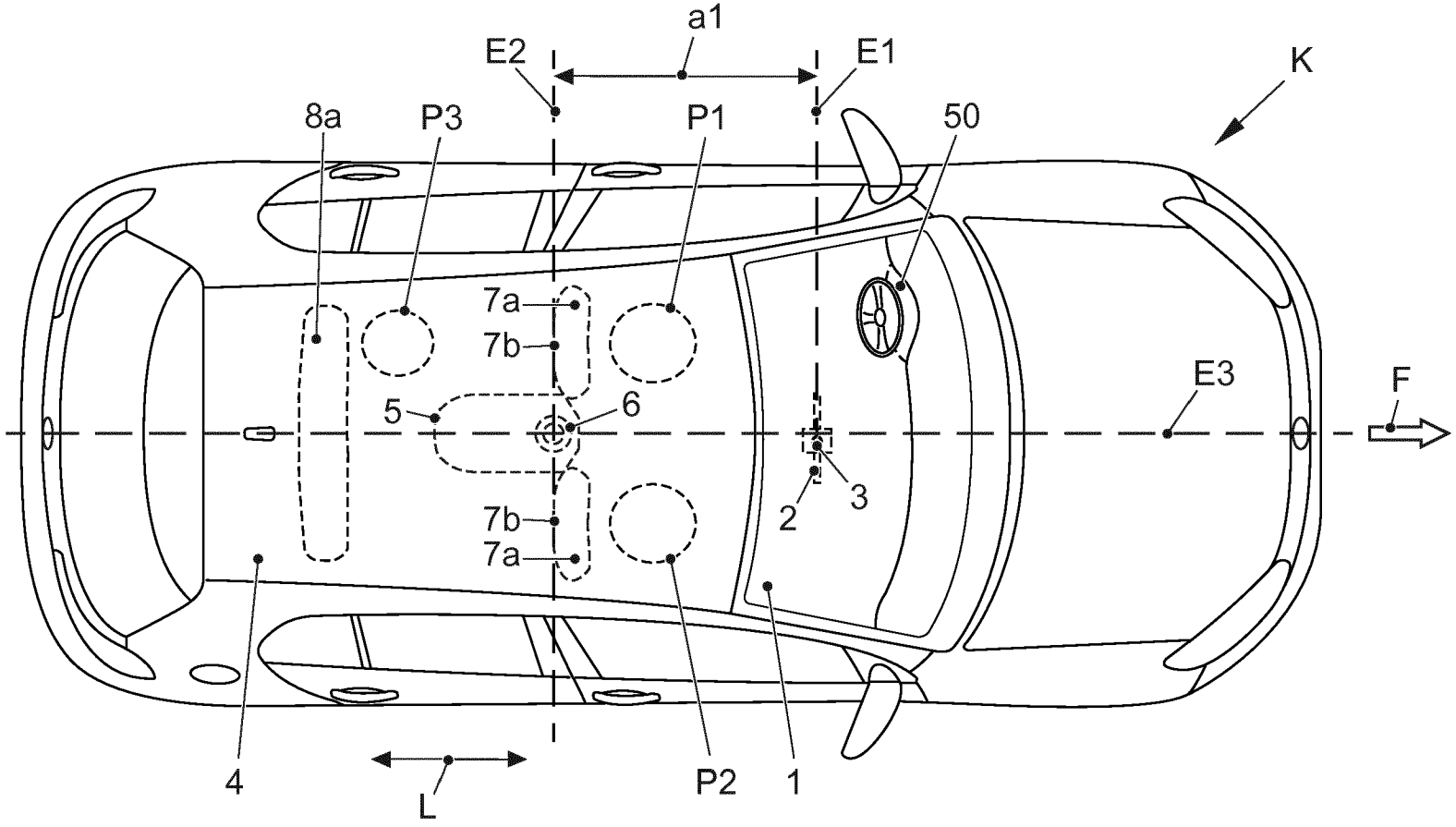
FIG. 2 shows a representation from above in accordance with view II from FIG. 1.

Reference will be made first to FIGS. 1 and 2.

In these FIGS., a motor vehicle K can be seen, wherein a windshield 1, an inner mirror 2, a microphone 3, and a roof liner 4 is provided. In the motor vehicle K, a vehicle driver P1 and a front-seat passenger P2 are seated on front seats 7 and a back-seat passenger P3 is seated on a back seat 8 directly behind the vehicle driver P1. The vehicle driver P1, the front-seat passenger P2 and the back-seat passenger P3 have all assumed usual seat positions, meaning their backs are at least nearly touching a seat backrest 7*a* or a backrest 8*a*. They are of average size.

The motor vehicle K is equipped with an emergency reporting device which can be actuated manually or automatically in the event of an emergency.

Only the parts of the emergency reporting device, namely the microphone 3 and one loudspeaker 6, are shown.

The microphone 3 and the loudspeaker 6 should allow a vehicle occupant, for example the vehicle driver P1, to speak and hear freely in the event of an emergency.

The microphone 3 is mounted to the inner mirror 2. Deviating from this, it is also conceivable to mount the microphone in the region of the roof liner 4, for example in the region of the transition between the windshield 1 and the roof liner 4. It may also be housed there, for example, in an illumination module (not shown).

The loudspeaker 6 is installed in a region of the head K1 of the vehicle driver P1 and also of the head K2 of the front-seat passenger, in particular in an illumination module 5 which is located in or arranged on the roof liner 4. For example, the loudspeaker 6 radiates downward in the direction of the vehicle floor, meaning orthogonally to a longitudinal direction L.

As can further be seen, the microphone 3 is thus arranged in a first plane E1. The plane E1 is a vertical cross-sectional plane through the vehicle K which is oriented perpendicular to the longitudinal direction L or to a usual direction of travel F of the motor vehicle K and is located in front of the vehicle driver P1 or in front of the front-seat passenger P2.

The loudspeaker 6, however, is arranged offset from the plane E1 by a distance a1 in a second plane E2 which extends parallel to the plane E1. Viewed in the direction of travel F, meaning from the direction of view of an observer standing at the rear of the motor vehicle K, the plane E1 lies behind the plane E2.

As can be seen, the plane E2 can extend such that it approximately touches a rear edge 7*b* of a seat backrest 7*a* in the selected seat position of the vehicle driver P1 or the front-seat passenger P2.

The proposed arrangement of some embodiments will be illustrated with reference to FIG. 3.

The microphone 3, which is arranged in the first plane E1, has a pronounced directivity. In particular, the microphone 3 has a directivity that is oriented both towards the vehicle driver P1 or his head K1 and also towards the front-seat passenger P2 or his head K2. In other words, a first region IF of higher or highest input sensitivity is oriented towards the vehicle driver P1 or his head K1. A second region $I_{BF}$ of higher or highest input sensitivity is oriented towards the front-seat passenger P2 or his head K2. Between the regions $I_F$ and $I_{BF}$, a region II of lower or lowest input sensitivity is formed. For this purpose, the microphone 3 may for example also be formed from a microphone array which consists of multiple microphones. For example, a microphone array consisting of three microphones is conceivable, wherein the microphones are arranged in a triangle with the "tip of the triangle" (not shown) pointing in the direction of travel F or counter to the direction of travel F.

The plane E2, on which the downwardly oriented loudspeaker 6 is located, is now arranged in a region of the head K1 of the vehicle driver P1 or of the head K2 of the front-seat passenger P2. In concrete terms, that means that the plane E2 can be arranged for this purpose in the region of an A-pillar 10. In this case, the term region of an A-pillar should be understood to mean such a region B2 that in the longitudinal direction L of the motor vehicle K also includes distances a2 and a3 on each side of the A-pillar 10, each of which can be multiple centimeters and are to be assessed as practicable and useful for the achievement of the desired acoustic properties. A range from approximately 10 to 20 cm is considered possible as a value for the distances a2 and a3.

Figure 3:
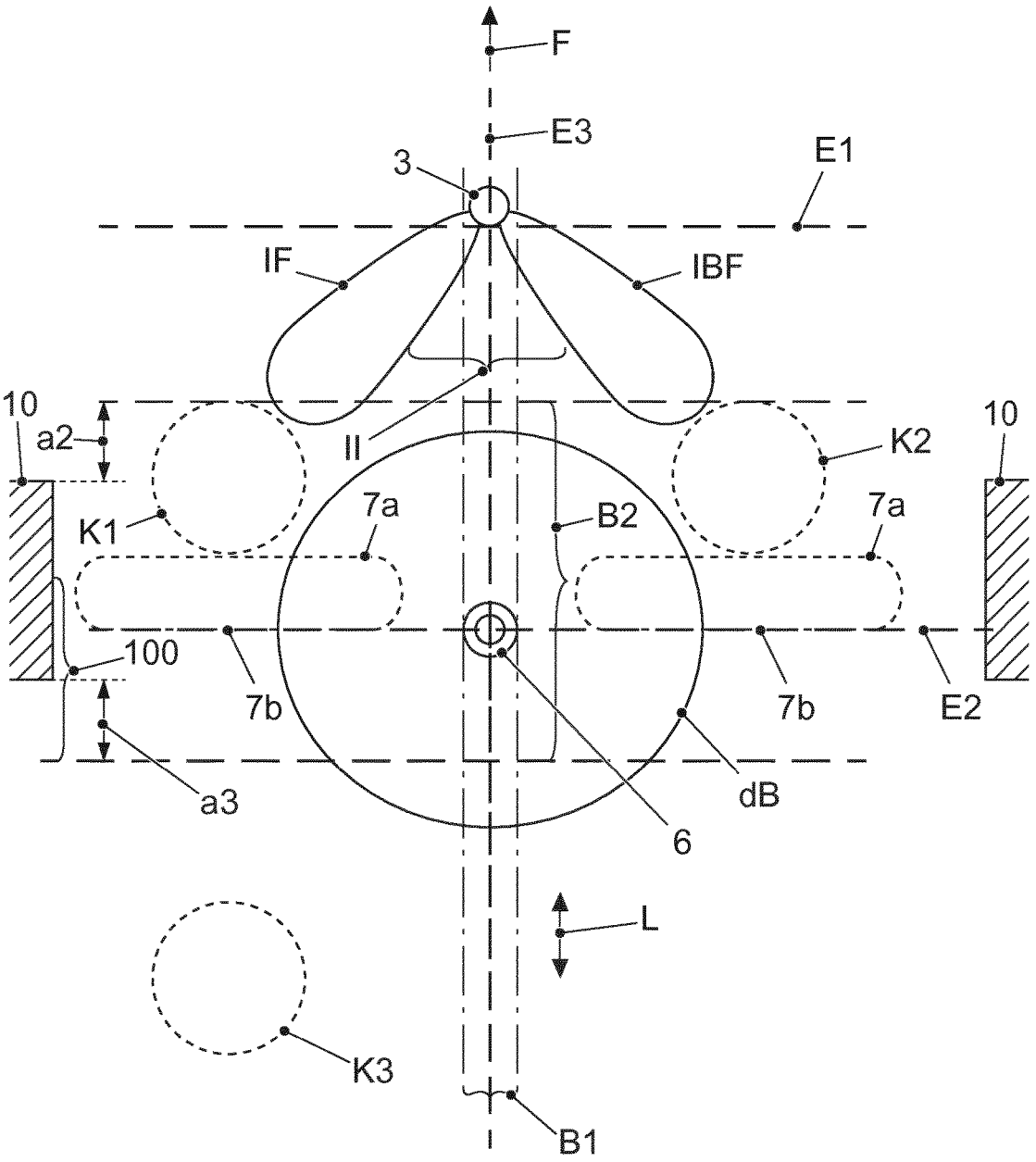
FIG. 3 shows a greatly simplified representation of the arrangement of the loudspeaker and the microphone comparable with view II from FIG. 1 in a first embodiment.

In the exemplary embodiment in accordance with FIG. 3, the plane E2, viewed counter to the direction of travel F, is arranged in a rear region 100 of the A-pillar 10. The rear region 100 starting from the center of the A-pillar 10 also comprises the distance a3. The plane E2 is thus located between the head K1 of the vehicle driver P1 and a head K3 of the back-seat passenger P3 (cf. also FIGS. 1 and 2).

Moreover, it should be noted that both the microphone 3 and the loudspeaker 6 are arranged in a central region B1 which contains a vertical longitudinal center plane E3 of the motor vehicle K. For example, both the microphone 3 and the loudspeaker 6 lie on this longitudinal center plane E3.

With the embodiment shown, it is also achieved that a sound pressure level dB emitted by the loudspeaker 6 primarily falls on the region II of lower or lowest input sensitivity of the microphone 3, in addition to the heads K1 and K2 of the vehicle driver P1 and front-seat passenger P2. The loudspeaker 6 is in particular a conventional loudspeaker without special directivity.

Figure 4:
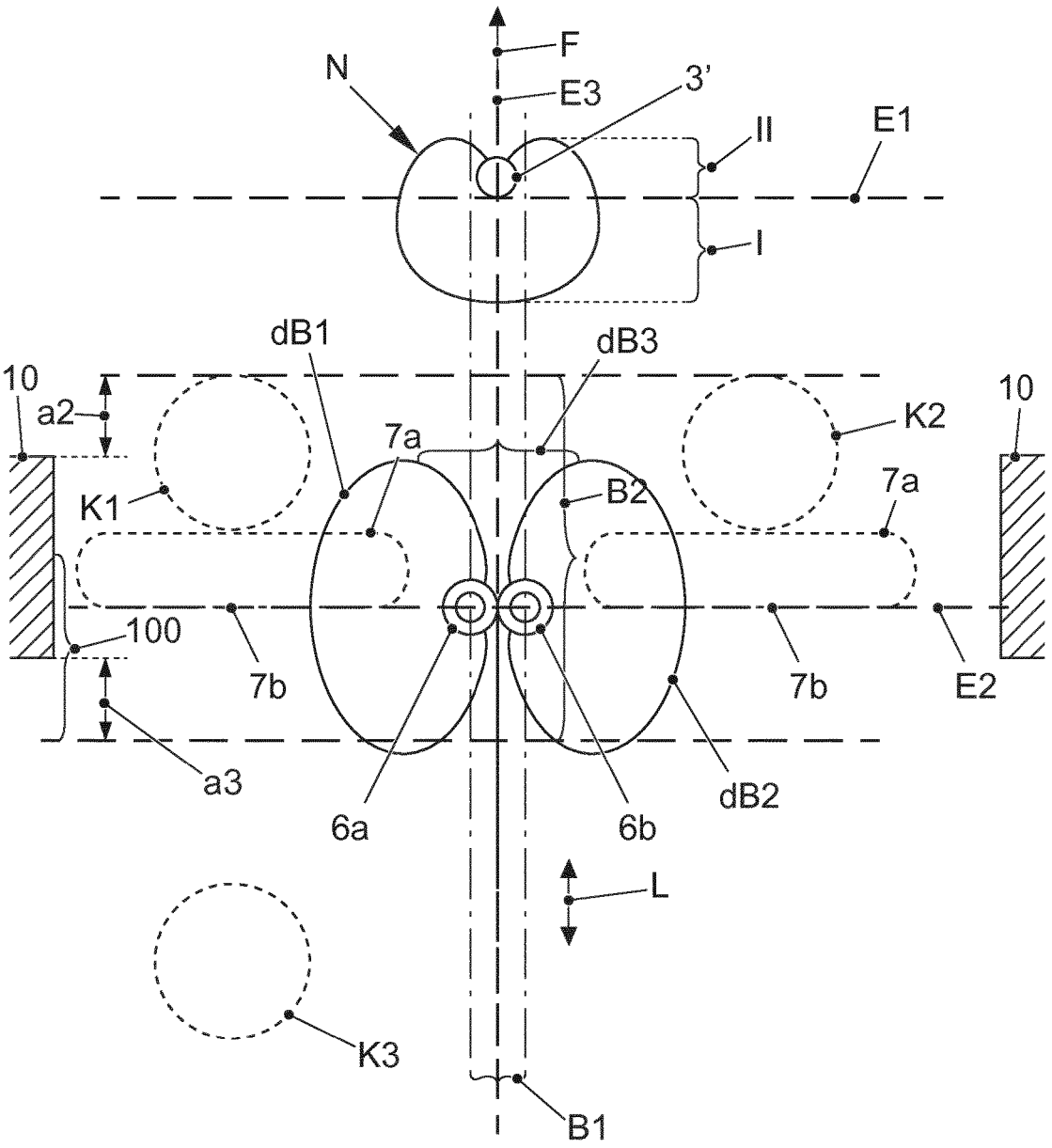
FIG. 4 a greatly simplified representation of the arrangement of the loudspeaker and the microphone comparable with view II from FIG. 1 in a second embodiment.

In FIG. 4, a constellation can now be seen in which a microphone 3' with a cardioid characteristic N is used. This characteristic thus provides no special orientation towards the vehicle driver P1 or the front-seat passenger P2 or their heads K1 and K2.

As a result of the cardioid characteristic N, a region I of higher or highest input sensitivity and a region II of lower or lowest input sensitivity are formed.

As can be seen, the region I faces the second plane E2. Two conventional loudspeakers 6*a* and 6*b* are arranged on the plane E2. In concrete terms, the loudspeakers 6*a*, 6*b* are connected as what is known as a dipole. This occurs such that a sound pressure level dB3 of the loudspeakers 6*a*, 6*b* in the direction of the microphone 3' is very low or minimal. Sound pressure levels dB1 and dB2 pointing in the direction of the head K1 of the vehicle driver P1 and the head K2 of the front-seat passenger P2 are much higher.

Such good acoustic properties can also be achieved using a microphone 3' with a cardioid characteristic. In this exemplary embodiment as well, the plane E2 is arranged in the rear region 100 of the A-pillar 10 and is located between the head K1 of the vehicle driver P1 and the head K3 of the back-seat passenger P3.

Moreover, the microphone 3' is located within the region B1, e.g., on the longitudinal center plane E3. In this case as well, the loudspeakers 6*a*, 6*b* are for example oriented downwards towards the vehicle floor and for example arranged centrally to the longitudinal center plane E3.

Figure 5:
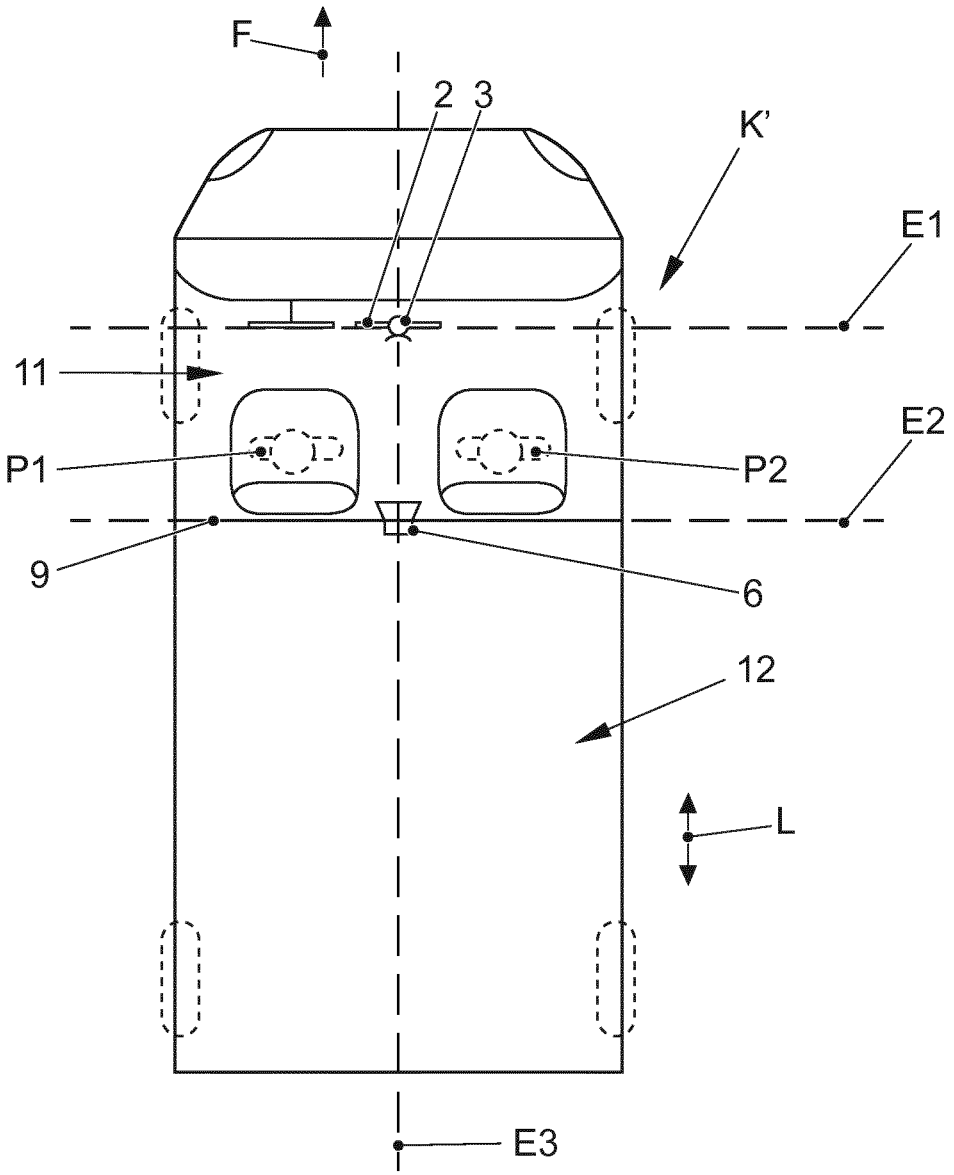
FIG. 5 a further motor vehicle with a further embodiment.

Finally, FIG. 5 shows a motor vehicle K' with an emergency reporting device consisting of a microphone 3 and a loudspeaker 6 in which the plane E2 coincides with a separating wall 9 located behind the vehicle driver P1 and the front-seat passenger P2. In this case, the loudspeaker 6 is thus mounted on or in the separating wall 9.

The motor vehicle K' is a commercial vehicle, wherein a passenger space 11 is separated from a rear space 12 designed as a cargo space by the separating wall 9.

The motor vehicle K' may, however, also be a sports car with only two seats, wherein the separating wall 9 corresponds to a rear wall and separates a passenger space 11 and a rear space 12 designed as an engine space.

LIST OF REFERENCE NUMBERS

1 Windshield
2 Inner mirror
3, 3' Microphone
4 Roof liner
5 Illumination module
6 Loudspeaker
6*a,b* Loudspeaker
7 Front seat
7*a* Seat backrest
7*b* Rear edge
8 Backseat
8*a* Backrest
9 Separating wall
10 A-pillar
11 Passenger space
12 Rear space
100 Rear region of the A-pillar
a1-a3 Distance
B1 Region
B2 Region
dB Sound pressure level
dB1, dB2, dB3 Sound pressure level
E1 First plane
E2 Second plane
E3 Longitudinal center plane
F Direction of travel
K, K' Motor vehicle
K1 Head of the vehicle driver
K2 Head of the front-seat passenger
K3 Head of the back-seat passenger
L Longitudinal direction of the motor vehicle
N Cardioid characteristic
P1 Vehicle driver
P2 Front-seat passenger
P3 Back-seat passenger
I Region of higher or highest input sensitivity
$I_F$ Region of higher or highest input sensitivity, oriented towards the vehicle driver
$I_{BF}$ Region of higher or highest input sensitivity, oriented towards the vehicle passenger
II Region of lower or lowest input sensitivity The invention has been described in the preceding using various exemplary embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit or device may fulfil the functions of several items recited in the claims.

The mere fact that certain measures are recited in mutually different dependent claims or embodiments does not indicate that a combination of these measures cannot be used to advantage. Any reference signs in the claims should not be construed as limiting the scope.

What is claimed is:

1. An emergency reporting device in a motor vehicle for one or more of manually and automatically reporting an emergency to a report center;

wherein a hands-free communication apparatus comprising at least one microphone and at least one loudspeaker can be used to communicate with a report center; wherein the microphone is arranged in a first vertical plane extending perpendicularly to a longitudinal direction of the motor vehicle, and the loudspeaker is arranged separate from the microphone in a second vertical plane extending perpendicularly to the longitudinal direction of the motor vehicle; wherein the microphone and the loudspeaker are additionally arranged in a central region of the motor vehicle containing a vertical longitudinal center plane; wherein the first plane, viewed from the front end of the motor vehicle, is located in front of the second plane and in front of a vehicle driver, and the second plane, viewed from the front end of the motor vehicle, is arranged in behind the vehicle driver;

wherein the loudspeaker is arranged in a region of the head of the vehicle driver.

2. The emergency reporting device of claim 1, wherein the second plane, viewed in the longitudinal direction of the motor vehicle, is arranged in the region of an A-pillar.

3. The emergency reporting device of claim 2, wherein the second plane, viewed counter to the direction of travel, is arranged in a rear region of the A-pillar.

4. The emergency reporting device of claim 3, wherein the loudspeaker is integrated into an illumination module which is arranged on a roof liner of the motor vehicle.

5. The emergency reporting device of claim 3, wherein the loudspeaker is arranged on a separating wall located behind the vehicle driver.

6. The emergency reporting device of claim 3, wherein the microphone has a directivity oriented towards the vehicle driver and a front-seat passenger, wherein the microphone and the loudspeaker are arranged within the central region on the vertical longitudinal center plane of the motor vehicle.

7. The emergency reporting device of claim 3, wherein the microphone has a cardioid characteristic, wherein two loudspeakers are present which are connected as a dipole such that a sound pressure level of the loudspeakers in the direction of the microphone is minimal.

8. The emergency reporting device of claim 2, wherein the loudspeaker is integrated into an illumination module which is arranged on a roof liner of the motor vehicle.

9. The emergency reporting device of claim 2, wherein the loudspeaker is arranged on a separating wall located behind the vehicle driver.

10. The emergency reporting device of claim 2, wherein the microphone has a directivity oriented towards the vehicle driver and a front-seat passenger, wherein the microphone and the loudspeaker are arranged within the central region on the vertical longitudinal center plane of the motor vehicle.

11. The emergency reporting device of claim 2, wherein the microphone has a cardioid characteristic, wherein two loudspeakers are present which are connected as a dipole such that a sound pressure level of the loudspeakers in the direction of the microphone is minimal.

12. The emergency reporting device of claim 1, wherein the loudspeaker is integrated into an illumination module which is arranged on a roof liner of the motor vehicle.

13. The emergency reporting device of claim 12, wherein the microphone has a directivity oriented towards the vehicle driver and a front-seat passenger, wherein the microphone and the loudspeaker are arranged within the central region on the vertical longitudinal center plane of the motor vehicle.

14. The emergency reporting device of claim 12, wherein the microphone has a cardioid characteristic, wherein two loudspeakers are present which are connected as a dipole such that a sound pressure level of the loudspeakers in the direction of the microphone is minimal.

15. The emergency reporting device of claim 1, wherein the loudspeaker is arranged on a separating wall located behind the vehicle driver.

16. The emergency reporting device of claim 15, wherein the microphone has a directivity oriented towards the vehicle driver and a front-seat passenger, wherein the microphone and the loudspeaker are arranged within the central region on the vertical longitudinal center plane of the motor vehicle.

17. The emergency reporting device of claim 15, wherein the microphone has a cardioid characteristic, wherein two loudspeakers are present which are connected as a dipole such that a sound pressure level of the loudspeakers in the direction of the microphone is minimal.

18. The emergency reporting device of claim 1, wherein the microphone has a directivity oriented towards the vehicle driver and a front-seat passenger, wherein the microphone and the loudspeaker are arranged within the central region on the vertical longitudinal center plane of the motor vehicle.

19. The emergency reporting device of claim 1, wherein the microphone has a cardioid characteristic, wherein two loudspeakers are present which are connected as a dipole such that a sound pressure level of the loudspeakers in the direction of the microphone is minimal.

20. An emergency reporting device in a motor vehicle for one or more of manually and automatically reporting an emergency to a report center; wherein a hands-free communication apparatus comprising at least one microphone and at least one loudspeaker can be used to communicate with a report center; wherein the at least one microphone is arranged in a first vertical plane extending perpendicularly to a longitudinal direction of the motor vehicle and the at least one loudspeaker is arranged separate from the at least one microphone in a second vertical plane extending perpendicularly to the longitudinal direction of the motor vehicle; wherein the at least one microphone and the at least one loudspeaker are additionally arranged in a central region of the motor vehicle containing a vertical longitudinal center plane; wherein the first plane, viewed in a typical direction of travel of the motor vehicle, is located behind the second plane, and the second plane, viewed counter to the direction of travel, is arranged in a region of the head of a vehicle driver; wherein the at least one microphone has a cardioid characteristic, wherein at least two loudspeakers are present which are connected as a dipole such that a sound pressure level of the at least two loudspeakers in the direction of the microphone is minimal.

* * * * *